US005367954A

United States Patent [19]

Becker

[11] Patent Number: 5,367,954

[45] Date of Patent: Nov. 29, 1994

[54] PRINTING-FORM CORRECTION DEVICE COMPENSATING FOR THE STRETCHING OF PRINT CARRIERS

[75] Inventor: Willi Becker, Bammental, Germany

[73] Assignee: Heidelberger Druckmaschinin AG, Heidelberg, Germany

[21] Appl. No.: 174,385

[22] Filed: Dec. 28, 1993

[30] Foreign Application Priority Data

Dec. 28, 1992 [DE] Germany ..... 4244279

[51] Int. Cl.[5] ..... B41F 1/28

[52] U.S. Cl. ..... 101/415.1; 101/378

[58] Field of Search ..... 101/415.1, 378, 379, 101/16.38, 408

[56] References Cited

U.S. PATENT DOCUMENTS

| | | | |
|---|---|---|---|
| 3,913,480 | 10/1975 | Dauner et al. | 101/415.1 |
| 4,130,058 | 12/1978 | Bocu | 101/415.1 |
| 4,730,557 | 3/1988 | Wieland | 101/415.1 |
| 5,076,167 | 12/1991 | Herold et al. | 101/415.1 |
| 5,094,165 | 3/1992 | Sugiyama et al. | 101/415.1 |
| 5,181,469 | 1/1993 | Merkel et al. | 101/415.1 |
| 5,182,994 | 2/1993 | Siguyama et al. | 101/415.1 |

FOREIGN PATENT DOCUMENTS 4128994 7/1992 Germany .

*Primary Examiner*—Eugene H. Eickholt

*Attorney, Agent, or Firm*—Herbert L. Lerner; Laurence A. Greenberg

[57] ABSTRACT

Device for receiving printing forms at one end thereof in a printing-unit cylinder of a rotary printing machine, wherein the printing-unit cylinder is a printing-form cylinder formed with a cylinder gap and having a shaft extending through the cylinder gap, includes a plurality of receptacle components respectively formed with pairs of mutually opposing clamping surfaces disposed on the shaft for gripping a printing form, at least one adjusting element for swiveling one of the surfaces of the respective pairs thereof formed on the receptacle components against a force of a tension spring acting in a tensioning direction, and the other of the surfaces of the respective pairs thereof formed on the receptacle components having a retaining element actuatable by the one adjusting element for swiveling the other of the surfaces against a force of another tension spring, the shaft being an expansion shaft, the receptacle components being individual gripper elements supported side by side on the expansion shaft in a manner fixed against relative rotation therewith, and including adjustment devices for expanding the expansion shaft linearly in axial direction, and preloading devices actuatable independently of one another upon individual ones of the gripper elements for twisting the expansion shaft in the circumferential direction.

12 Claims, 3 Drawing Sheets

Figure 1:
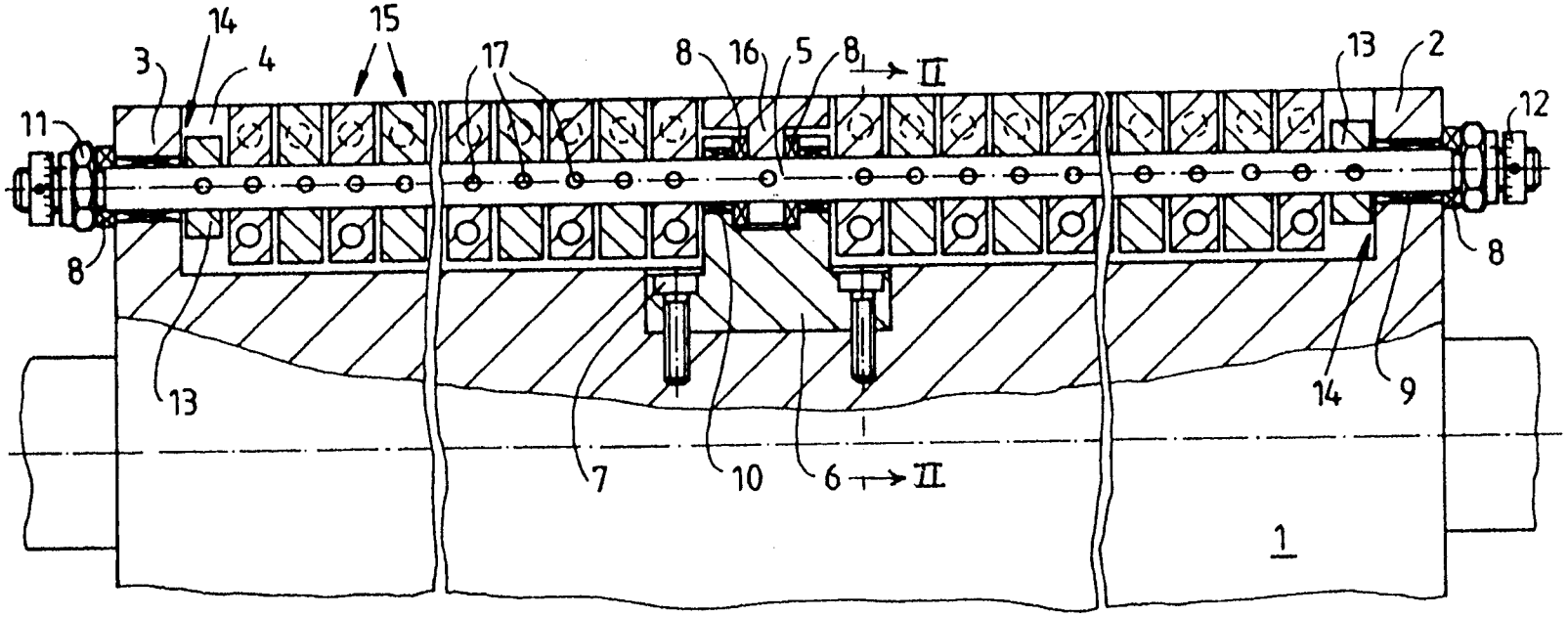

PRINTING-FORM CORRECTION DEVICE COMPENSATING FOR THE STRETCHING OF PRINT CARRIERS

The invention relates to a printing-form correction device compensating for the stretching of print carriers and, more particularly, the invention relates to a device for receiving printing forms at one end thereof in a printing-unit cylinder of a rotary printing machine, wherein the printing-unit cylinder is a printing-form cylinder formed with a cylinder gap and having a shaft extending through the cylinder gap, a plurality of receptacle components respectively formed with pairs of mutually opposing clamping surfaces disposed on the shaft for gripping a printing form, at least one adjusting element for swiveling one of the surfaces of the respective pairs thereof formed on the receptacle components against a force of a tension spring acting in a tensioning direction, and the other of the surfaces of the respective pairs thereof formed on the receptacle components having a retaining element actuatable by the one adjusting element for swiveling the other of the surfaces against a force of another tension spring.

The published German Patent Document DE 41 28 994 A1 discloses a clamping and tensioning device for printing machines by which printing plates are clamped and subjected to tension.

This reference shows a tensioning bar formed of a plurality of parts, and a clamping bar formed of a plurality of parts arranged side by side. A printing plate clamped between the mutually opposed clamping surfaces is accordingly fixed within individual subregions defined by the length of the parts of the clamping bars. Should the print carrier become stretched, for example, in the axial direction or, in other words, parallel to the clamping and tensioning device during the printing process, due to the influence of moisture or due to fulling phenomena in the cylinder gaps of the printing-unit cylinders, it is then necessary to compensate for the position of the printing form; however, such compensation is not achievable with the device of the aforementioned published German patent document. To adjust or accommodate the printing form to printing conditions which have changed due to the stretching of the print carrier, adjustment or accommodation of the location of the trailing or rear edge of the printing form is necessary. Because the fixing of the printing form in the device according to the aforementioned prior art occurs regionally, however, the clamping device thereof must be opened for correction, to enable the performance of a position change in the printing form.

The stretching of the print carrier can be caused, not only by the absorption of moisture by the print carrier, but also due to the location of the wood fibers in the print carrier, when the latter is formed of paper or cardboard or the like.

A variable inking or application of ink to individual portions of the print carrier can also result in stretching of the print carrier medium both circumferentially, as well as axially. These effects cannot be overcome with the device of the prior art described in the aforementioned published German Patent Document DE 41 28 994 A1.

It is accordingly an object of the invention to provide a printing-form correction device compensating for the stretching of print carriers which avoids or overcomes the disadvantages of the aforementioned prior art.

It is a further object of the invention to provide an improved device for receiving printing forms wherein a printing form can be adjusted or accommodated, while in the clamped condition, to changes in the printed image due to the stretching of the print carrier which is being processed.

With the foregoing and other objects in view, there is provided, in accordance with the invention, a device for receiving printing forms at one end thereof in a printing-unit cylinder of a rotary printing machine, wherein the printing-unit cylinder is a printing-form cylinder formed with a cylinder gap and having a shaft extending through the cylinder gap, includes a plurality of receptacle components respectively formed with pairs of mutually opposing clamping surfaces disposed on the shaft for gripping a printing form, at least one adjusting element for swiveling one of the surfaces of the respective pairs thereof formed on the receptacle components against a force of a tension spring acting in a tensioning direction, and the other of the surfaces of the respective pairs thereof formed on the receptacle components having a retaining element actuatable by the one adjusting element for swiveling the other of the surfaces against a force of another tension spring, the shaft being an expansion shaft, the receptacle components being individual gripper elements supported side by side on the expansion shaft in a manner fixed against relative rotation therewith, and including adjustment devices for expanding the expansion shaft linearly in axial direction, and preloading devices actuatable independently of one another upon individual ones of the gripper elements for twisting the expansion shaft in the circumferential direction.

With this construction according to the invention, a uniform, linearly extending expansion or elongation of the printing form from inside towards the outside, which is largely proportional to the stretching of the print carrier, is realizable. To attain the axial expansion at one end of the printing form, a release of the clamping itself is unnecessary. Because of the torsional lability of the expansion shaft, the individual gripper or clamping elements which are disposed on the shaft can adapt better to non-parallel plate canting, and assure uniform gripping or clamping of the printing form in the circumferential direction. Because it is then possible, by means of the preloading devices associated with the various gripper elements, to subject the printing form to different amounts of tension in the circumferential direction, even zonal stretching of the print carrier in the circumferential direction can be compensated for by the aforedefined device according to the invention.

In accordance with another feature of the invention, the device for receiving printing forms includes cylinder cheeks and a support bearing formed on the printing-form cylinder, the expansion shaft being rotatably received in the cylinder cheeks and in axial bearings thereat, and being fixed against rotation in the support bearing, as well as fixed against axial displacement in the axial bearings. Moreover, in accordance with a further feature of the invention, the expansion shaft has a torsionally labile construction, and fastening elements are provided for fastening the individual gripper elements to the expansion shaft.

Thus, on the one hand, starting from the middle of the printing-form cylinder, tensile strains effecting uniformly extending linear expansions or elongations can be introduced into the expansion shaft, while the torsionally labile construction thereof permits maximum torsion of individual regions of the expansion shaft, free of side effects, in order to exert, in the circumferential direction, tension which takes a zonally varying course.

In accordance with an added feature of the invention, the axial bearings are roller bearings disposed between the adjusting devices and the cylinder cheeks. Head friction at the cylinder cheeks can thereby be effectively precluded, yet the actuation forces to be employed can be kept small.

In accordance with an additional feature of the invention, the device for receiving printing forms includes respective expansion limiting rings disposed on the expansion shaft on respective end regions thereof between respective inner sides of the cylinder cheeks and respective outermost gripper elements of the plurality of gripper elements. Deformation of the expansion shaft can thus be limited to the elastic range, and excessive strains or stresses are precluded.

In accordance with yet another feature of the invention, each of the gripper elements comprises a gripper seat member and a gripper lever.

In accordance with yet a further feature of the invention, the gripper seat member is formed with a lever projection having a bolt extending therethrough. The gripper lever, which is movable relative to the gripper seat member, is swivelably mounted on the bolt.

In accordance with yet an added feature of the invention, the gripper lever is formed with a lever projection, and a protruding wall partly defining the cylinder gap is formed on the printing-form cylinder, the gripper lever being swivelable into a position wherein the lever projection thereof is braced against the protruding wall.

The relative movement between the gripper lever and the gripper seat member is effected by a bracing of the lever projection of the gripper lever against cylinder-gap defining protruding wall of the printing-form cylinder due to the hydraulically or pneumatically produced swiveling or deflection of the gripper seat member. The clamping surfaces of the gripper seat member and the gripper lever thereby open or disengage so that a printing form can be introduced therebetween.

In accordance with yet additional features of the invention, the preloading devices are operatively engageable with the gripper seat member of the gripper elements, respectively, for acting thereon.

In accordance with still another feature of the invention, the preloading devices include a pair of members, one of the members thereof being formed as a setscrew, the setscrew having a preloading influence on the other of the members thereof.

In accordance with an alternative feature of the invention, the preloading devices respectively comprise setscrews operatively engageable directly with the gripper seat member of the gripper elements secured on the expansion shaft for acting directly on the gripper seat member.

Thus, preloading devices also act upon the gripper seat member of the gripper elements. Because the gripper seat member is secured to the torsionally labile expansion shaft, the position of each gripper element can be varied in the circumferential direction by the preloading devices. For one, prestressing devices in the form of setscrews can thus vary the preloading of a further preloading device, an example being the spring characteristic of a compression spring acting upon the lever projection of the gripper seat member. For another, prestressing devices formed as setscrews can act directly upon the gripper seat member of the gripper elements secured to the expansion shaft. As a result, the strain or tension on the printing form and thus the expansion of the printing form in the circumferential direction can be adapted or adjusted to the varying stretching of the print carrier from printing unit to printing unit.

In accordance with a concomitant feature of the invention, the device for receiving printing forms includes scales mounted on respective end regions of the expansion shaft for securing the adjustment devices thereon.

Other features which are considered as characteristic for the invention are set forth in the appended claims.

Although the invention is illustrated and described herein as embodied in a printing-form correction device compensating for the stretching of print carriers, it is nevertheless not intended to be limited to the details shown, since various modifications and structural changes may be made therein without departing from the spirit of the invention and within the scope and range of equivalents of the claims.

Figure 2:
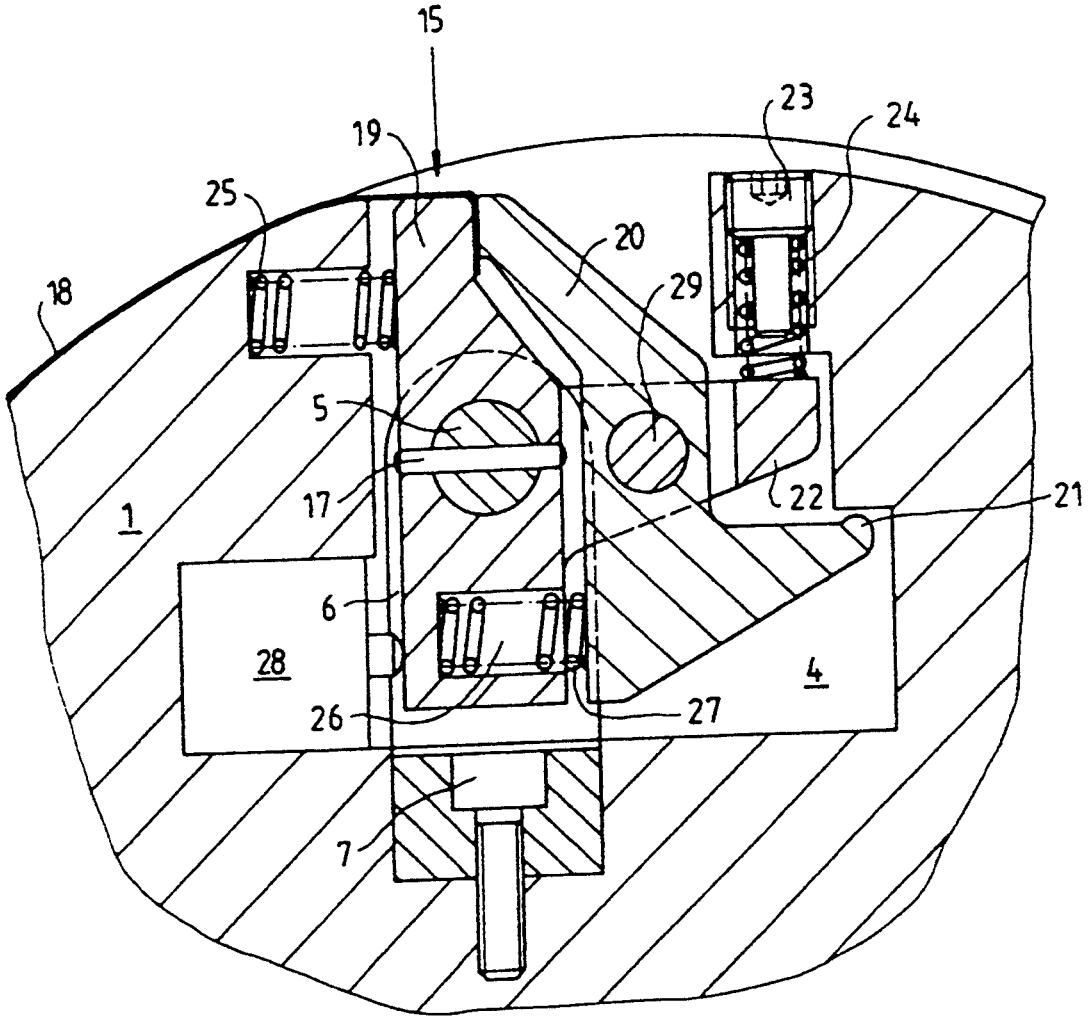
Figure 3:
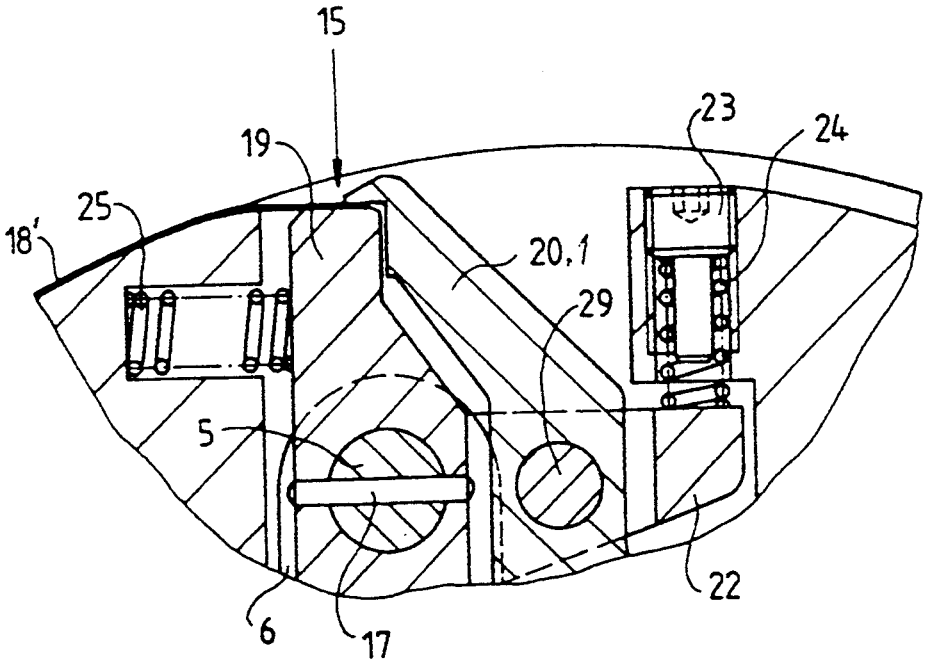

The construction and method of operation of the invention, however, together with additional objects and advantages thereof will be best understood from the following description of specific embodiments when read in connection with the accompanying drawings, in which:

FIG. 1 is a longitudinal sectional view of a printing form cylinder, taken through a cylinder gap formed therein;

FIG. 2 is an enlarged cross-sectional view of FIG. 1 taken along the line II—II in the direction of the arrows, and showing the cylinder gap of the printing form cylinder and a gripper element and gripper bar thereof in greater detail; and FIG. 3 is a fragmentary, further enlarged view of FIG. 2, showing a gripper bar in a configuration differing from that of FIG. 2 in the cylinder gap of the printing form cylinder.

Referring now to the drawings and, first, particularly to FIG. 1 thereof, there is shown therein, in a longitudinal sectional view, a printing-form cylinder 1 formed with two cylinder end pieces or cheeks 2 and 3, respectively, receiving a radial bearing 9 in respective bores. An expansion shaft 5 which extends through a cylinder gap 4 provided in the printing-form cylinder 1 is received in the radial bearings 9. The expansion shaft 5 is supported in the middle thereof by a support bearing 6, which is secured with retaining screws 7 in the printing-form cylinder 1. The expansion shaft 5 extends through radial bearings 10 which are provided in the support bearing 6. Individual gripper elements 15 are mounted on both sides of a middle element 16 on the expansion shaft 5 and are fixed in position on the expansion shaft by retaining bolts 17. The individual gripper elements 15 are adjustable independently of one another. Expansion limiting rings 13 are secured to the expansion shaft 5 at the ends thereof, in the vicinity of the cylinder cheeks 2 and 3 and at the inner side thereof. Respective threaded lengths or sections are formed at each end of the expansion shafts 5, respectively, to the outside of each of the cylinder cheeks 2 and 3, and an adjusting element 11, in the form, for example, of a check or lock nut, is threadedly movable thereon. Both threaded sections are protected by a respective scale 12. The scale 12 permits a readout of the length of the adjustment travel path by the lock nut 11. To reduce head friction between the outer surfaces of the cylinder cheeks 2 and 3 and bearing surfaces of the adjusting elements 11, axial bearings 8 are provided between the respective cylinder cheeks 2 and 3, on the one hand, and the respective adjusting elements 11, on the other hand. An air gap 14 which is a few tenths of a millimeter wide is located between the respective expansion limiting rings 13 and the respective inner sides of the cylinder cheeks 2 and 3.

If an end of a printing form which is in clamped condition on the printing-form cylinder 1 is to be adapted or accommodated to the stretching of a print carrier in axial direction thereof, the pressman moves each of the adjusting elements 11 in a respective direction towards the cylinder cheeks 2 and 3. The axial bearings 8 thereby press against the the respective outsides of the cylinder cheeks 2 and 3, so that the expansion shaft 5 is placed under tensile strain at both ends thereof. Other axial bearings 8 provided on the support bearing 6 are fitted free of play into bifurcated projections of the support bearing 6. In printing machines having a wider construction, several of the support bearings 6 may be provided across the length of the printing-form cylinder 1. In such a case, the expansion shaft 5 is then axially fixed at the middle support bearing 6 thereof, while conversely the other support bearings 6 permit axial movement. A further increase in tension due to the rotation of the adjusting elements or lock nuts 11 causes an outward displacement, in the direction towards the cylinder cheeks 2 and 3, of the gripper elements 15 located closest to the middle element 16. Because the length of the displacement paths traversed by the individual gripper elements 15, when tension is exerted on the expansion shaft 5, are progressively cumulative from the inside to the outside, the respectively outermost gripper elements 15 travel the longest distance. Accordingly, a progressive expansion or elongation of the expansion shaft 5 occurs which proceeds linearly from the inside to the outside at both sides or ends of the expansion shaft 5, and thus, because the individual gripper elements 15 assume these fixed positions, an increasing linear displacement of the individual gripper elements 15 takes place linearly from the inside to the outside.

Because these displacements of the individual gripper elements 15 take place linearly from the inside to the outside, a correction of the location of a printing form which is in the clamped state can be performed. Because the expansion or elongation proceeds from the inside towards the outside, the edge of the printing form is uniformly gripped from the inside towards the outside, so that no unevenness arises at the clamping location. The expansion or elongation of the expansion shaft 5 and the attendant axial displacements of individual gripper elements 15 correspond to the stretching of the print carrier in the axial direction. The printing form is accordingly rapidly adaptable or accommodatable in the axial direction to any stretching that might be conditioned or dependent upon moisture or dampness, without having to release the clamping action. Moreover, when the print carrier travels from one printing unit to another through the printing machine, it is subjectible to various different amounts of axial stretching; with the device according to the invention, individual adaptations or accommodations are possible. The expansion limiting rings 13, which are provided at the inner sides of the cylinder cheeks 2 and 3, prevent excessive stressing of the expansion shaft 5 and keep the tensile strains, which are being brought to bear by the adjusting elements 11, within a permissible, elastic range. If the expansion limiting rings 13 rest on the respective inner sides of the cylinder cheeks 2 and 3, the gripper elements 15 cannot be displaced any farther.

FIG. 2 is a fragmentary cross-sectional view taken through a cylinder gap of a printing-unit cylinder such as a printing form cylinder and through a gripper element located therein.

Within the cylinder gap 4, which extends through the form cylinder 1, is the support bearing 6, which is threadedly secured to the form cylinder 1. The expansion shaft 5 extending through the support bearing 6 carries the gripper elements 15, which are secured by retaining bolts 17. Each gripper element 15 includes a gripper seat member 19 and a gripper lever 20. A lever projection 22 is formed on the gripper seat member 19, and is, in turn, formed with a bore wherein a bolt 29 is received, and also formed with a bearing face engageable by a setscrew 23 and a spring 24. The gripper lever 20, which is pivotable about the bolt 29 of the lever projection 22, is formed with a lever extension 21 which comes to rest beneath a protruding wall of the form cylinder 1 partly defining the cylinder gap 4, when the gripper lever 20 is swiveled counter-clockwise about the bolt 29, as viewed in FIG. 2. A pneumatic cylinder unit 28 having a piston rod or tappet which acts upon the gripper seat member 19 is also received in the forth cylinder 1. Above the pneumatic cylinder unit 28, tension springs 25 are received in a recess formed in the form cylinder 1 and act upon the individual gripper elements 15.

In the operating phase of the device according to the invention shown in FIG. 2, a printing form 18 is introduced by the conventionally bent-away end thereof into the gripper elements 15, the pneumatic cylinder unit 28 is inactive at that time, and tensioning and stretching of the printing form 18 on the jacket or outer cylindrical surface of the form cylinder 1 is effected by the tension springs 25, which act upon the individual gripper elements 15. The bent-away edge of the form 18 is received between the gripper seat member 19 and the gripper lever 20. The clamping in this condition results from an application of pressure by clamping springs 27, which are received in a recess 26 foraged in the gripper seat member 19, against the gripper lever 20 which is caused to swivel about the bolt 29 and into pressing engagement with the gripper seat member 19 and thereby clamp the bent-away end of the printing form 18 therebetween.

In the clamped condition, due to the action of the setscrew 23 upon the compression spring 24, which has an effect upon a preloading of this spring, each gripper element 15 can be twisted or swiveled in the circumferential direction. As a result of the application of spring force from the spring 24 upon the lever projection 22, the gripper seat member 19 is twisted about the expansion shaft 5 of torsionally unstable or labile construction, due to which a possibility arises of zonally expanding the printing form 18 in the circumferential direction. Because each gripper element 15 has a set screw 23 with a spring 24, the printing form 18 can be varied sensitively in the circumferential direction, and various different tensioning forces can be set from one printing unit to another, either by means of a change in initial spring loading or by means of the setscrew 23 itself. The setscrew 23 can act not only indirectly via the spring 24 but also directly on the bearing surface of the lever projection 22. The torsionally labile construction of the expansion shaft 5 assures that the strains or stresses individually set in the circumferential direction are transferred to the printing form 18 and cause an expansion or stretching thereof, for example, along the marginal zones of the printing form 18, of a few tenths of a millimeter in the circumferential direction, in order to compensate for a corresponding stretching of the print carrier in the circumferential direction.

The clamping of the printing form 18 is released by the action of the pneumatic cylinder unit 28. The outwardly moving tappet or piston rod cancels out the preloading exerted by the tension spring 25 and thus relaxes the printing form 18. When the tappet or piston rod moves out of the pneumatic cylinder unit 28, the lever projection 21 strikes the protruding wall of the printing-form cylinder 1 partly defining the cylinder gap 4, and upon further rotation of the gripper seat member 19, compresses the clamping spring 27, and upon a resultant rotation of the gripper lever 20 about the bolt 29, releases or undoes the clamping of the printing form 18 at the bent-away edge thereof. The printing form 18 can then be removed from the gripper elements 15.

FIG. 3 is an enlarged fragmentary view of FIG. 2 showing a detail of the printing-form cylinder having a gripper lever with a special configuration differing from that of FIG. 2. A movable gripper lever 20.1 is rotatably supported on the lever projection 22 of the gripper seat member 19, which is mounted on the expansion shaft 5 and secured thereon by retaining bolts 17 so as to be fixed against relative rotation therewith. As noted hereinabove, the gripper lever 20.1 has a different configuration from that of the gripper lever 20 and is capable of clamping against the gripper seat member 19 a printing form 18' of the type having no bent-away end. For this purpose, a lever head is formed on the gripper lever 20.1 and presses the end of the printing form 18' against an upper edge of the gripper seat member 19, as viewed in FIG. 3, and thus produces the required clamping force. Via the setscrew 23 and the spring 24, the preloading or prestressing forces acting upon the lever projection 22 can be adjusted or set in a manner analogous to that for the embodiment of FIG. 2.

By means of the device according to the invention, expansions or stretchings of the print carrier in the axial and/or circumferential direction can be compensated for, by means of the expansion or stretching thereof, without having to release the clamping of the printing form. This can be done individually for each printing unit, because the stretchings or expansions of the print carrier medium may vary from one printing unit to another.

I claim:

1. Device for receiving printing forms at one end thereof in a printing-unit cylinder of a rotary printing machine, wherein the printing-unit cylinder is a printing-form cylinder formed with a cylinder gap and having a shaft extending through the cylinder gap, comprising a plurality of receptacle components respectively formed with pairs of mutually opposing clamping surfaces disposed on the shaft for gripping a printing form, at least one adjusting element for swiveling one of the surfaces of the respective pairs thereof formed on the receptacle components against a force of a tension spring acting in a tensioning direction, and the other of the surfaces of the respective pairs thereof formed on the receptacle components having a retaining element actuatable by the one adjusting element for swiveling the other of the surfaces against a force of another tension spring, the shaft being an expansion shaft, the receptacle components being individual gripper elements supported side by side on said expansion shaft in a manner fixed against relative rotation therewith, and including adjustment devices for expanding said expansion shaft linearly in axial direction, and preloading devices actuatable independently of one another upon individual ones of said gripper elements for twisting said expansion shaft in the circumferential direction.

2. Device for receiving printing forms according to claim 1, including cylinder cheeks and a support bearing formed on said printing-form cylinder, said expansion shaft being rotatably received in said cylinder cheeks and in axial bearings thereat, and being fixed against rotation in said support bearing, as well as fixed against axial displacement in said axial bearings.

3. Device for receiving printing forms according to claim 1, wherein said expansion shaft has a torsionally labile construction, and including fastening elements for fastening said individual gripper elements to said expansion shaft.

4. Device for receiving printing forms according to claim 2, wherein said axial bearings are roller bearings disposed between said adjusting devices and said cylinder cheeks.

5. Device for receiving printing forms according to claim 2, including respective expansion limiting rings disposed on said expansion shaft on respective end regions thereof between respective inner sides of said cylinder cheeks and respective outermost gripper elements of said plurality of gripper elements.

6. Device for receiving printing forms according to claim 1, wherein each of said gripper elements comprises a gripper seat member and a gripper lever.

7. Device for receiving printing forms according to claim 6, wherein said gripper seat member is formed with a lever projection having a bolt extending therethrough.

8. Device for receiving printing forms according to claim 6, wherein said gripper lever is formed with a lever projection, and a protruding wall partly defining the cylinder gap is formed on the printing-form cylinder, and wherein said gripper lever is swivelable into a position wherein said lever projection thereof is braced against said protruding wall.

9. Device for receiving printing forms according to claim 6, wherein said preloading devices are operatively engageable with said gripper seat member of said gripper elements, respectively, for acting thereon.

10. Device for receiving printing forms according to claim 9, wherein said preloading devices include a pair of members, one of said members thereof being formed as a setscrew, said setscrew having a preloading influence on the other of said members thereof.

11. Device for receiving printing forms according to claim 9, wherein said preloading devices respectively comprise setscrews operatively engageable directly with said gripper seat member of said gripper elements secured on said expansion shaft for acting directly on said gripper seat member.

12. Device for receiving printing forms according to claim 2, including scales mounted on respective end regions of said expansion shaft for securing said adjustment devices thereon.

* * * * *